United States Patent [19]

Yang

[11] Patent Number: 4,612,830

[45] Date of Patent: Sep. 23, 1986

[54] TORQUE WRENCH

[76] Inventor: Miriam Yang, No. 23, Lane 240, Li Jen Road, Da Li Hsiang, Taiwan

[21] Appl. No.: 772,667

[22] Filed: Sep. 5, 1985

[51] Int. Cl.[4] ..... B25B 13/46

[52] U.S. Cl. ..... 81/63.2; 192/43.1

[58] Field of Search ..... 81/63, 63.2; 192/43.1

[56] References Cited

U.S. PATENT DOCUMENTS

| | | | |
|---|---|---|---|
| 3,044,591 | 7/1962 | Kilness | 81/63.2 X |
| 3,096,659 | 7/1963 | Jenkins | 81/63.2 X |
| 3,393,587 | 7/1968 | Jolliff et al. | 81/63.2 |
| 4,147,076 | 4/1979 | Wright et al. | 81/63.2 |

FOREIGN PATENT DOCUMENTS

| | | | |
|---|---|---|---|
| 2227616 | 12/1973 | Fed. Rep. of Germany | 81/63.2 |

*Primary Examiner*—James G. Smith

*Attorney, Agent, or Firm*—Limbach, Limbach & Sutton

[57] ABSTRACT

A ratchet wrench which includes a handle connected to a housing having a plurality of inwardly projecting teeth on its inner side, and a torgue transmitting member provided in the housing which has a shaft extending therefrom. The cylindrical body has as axial groove opening at its peripheral surface, a bore extending radially outward to communicate with the groove, and a protrusion means received in the bore and biassed radially. The groove is confined by two diverging surfaces, and two converging surfaces extending from the diverging surfaces respectively. A pawl is axially disposed in the groove. It has a first longitudinal tapered end portion to engage with the teeth, a second longitudinal opposite end portion to engage with corners of the groove, and a recess in the second end portion for engaging with the protrusion means. The second end portion is movable between two corners of the groove to change the engaging position of the first end portion with respect to teeth.

5 Claims, 7 Drawing Figures

TORQUE WRENCH

BACKGROUND OF THE INVENTION

This invention relates to a torque wrenche, particularly to a ratchet wrench of variable direction.

Ratchet wrenches with direction-adjusting means are generally complicated in construction. A ratchet wrench which is of simpler construction is shown in FIG. 1. It includes a cylindrical housing with a handle and a plurality of ratchet teeth on the inner side of the wall thereof, a torque transmitting member, which is of a cylindrical body 11 with a circumferential groove of semi-circular cross-section, being mounted in the housing. A pawl member 13 is pivoted to the cylindrical body 11 by means of a pin 14, and can be operated manually through a control knob 12 to change its position relative to the ratchet teeth, so that the cylindrical body can be rotated clockwise or anticlockwise. When a torque is applied, it will be transmitted to the cylindrical body 11 through the housing and the pawl 13. Since the pawl 13 is pivoted, the possible tolerance of the pawl against the torque is limited. If the applied torque is very large, the pawl will break at the portion where it is pivoted. Moreover, the construction of pawl 13 involves complicated machining processes, such as forging, milling, drilling, etc., which do not consistently provide accurate dimensions, thus increasing the tendency for the pawl to be damaged at its pivoted portion.

SUMMARY OF THE INVENTION

An object of the invention is to provide a ratchet wrench of simple construction in which the operating angular direction is adjustable and which can overcome the above described drawbacks.

This and other objects can be achieved in accordance with the invention through the provision of a ratchet wrench which comprises a handle connected to a cylindrical housing having a plurality of teeth, each of which has two converging faces and projects inwardly from the inner side of the wall thereof, and a torque transmitting member which has a cylindrical body mounted in the housing and a shaft extending from one end of the body out of the housing. The cylindrical body has an axial groove opening at its peripheral surface, a bore extending radially outward to communicate with the groove, and a protrusion means received in the bore and biassed radially. The groove is confined by two diverging surfaces which are symmetrical with the axis of the bore, two converging surfaces extending from the diverging surfaces respectively and being symmetrical with the axis of the bore, and two edges each of which interconnects the converging surface and the peripheral surface of the body.

There is further provided a pawl means having a pawl body axially disposed in the groove and having an oblong cross-section in the plane perpendicular to the axis of said cylindrical body, the body having a first longitudinal end portion to engage with the teeth, and a second longitudinal end portion which is opposite the first longitudinal end portion and is provided with a recess which receives the protrusion means of the cylindrical body. The second longitudinal end portion is movable between two corners formed by adjacent diverging and converging surfaces by passing through the protrusion means to change the first longitudinal end portion from a first position, in which the first longitudinal end portion engages with the teeth to cause the cylindrical body to move anticlockwise together with the housing, to a second position, in which the first longitudinal end portion engages with the teeth to cause the cylindrical body to move clockwise together with the housing. The protrusion means thrusts the pawl body, causing the first and second end portions to engage with the teeth and the corners of the grooves respectively.

According to one aspect of the invention, the protrusion means includes a hollow cylindrical body received in the bore and having a round closed end projecting outward, and a helical spring received in the bore and biassing the hollow cylindrical body.

According to another aspect of the invention, the pawl means further includes a portion of rectangular cross-section projecting out of the housing, and a guide plate which is fixed to the projecting portion and is provided with a knob thereon for operating the pawl means.

The present exemplary preferred embodiment will be described in detail with reference to the following drawings, in which:

DETAILED DESCRIPTION OF THE PREFERRED EMBODIMENT

Figure 1:
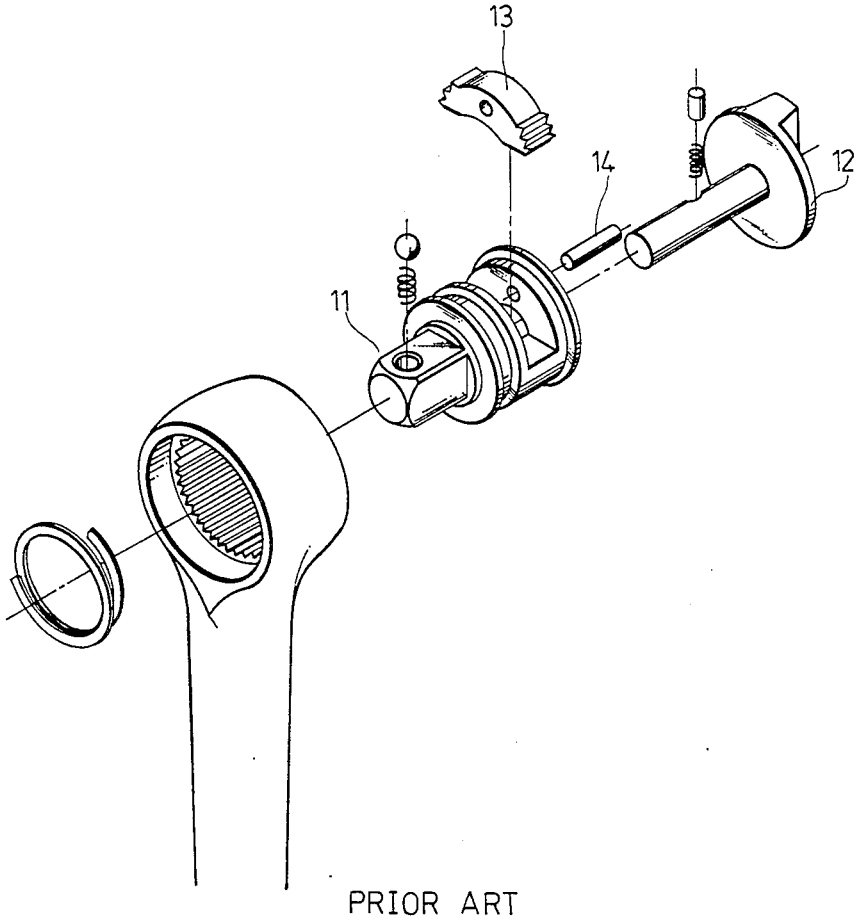
PRIOR ART FIG. 1
FIGS. 1 and 2 show conventional ratchet wrench.
Figure 2:
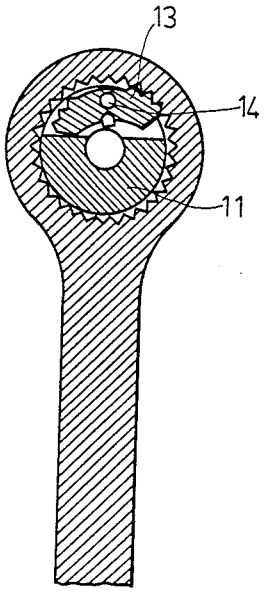
PRIOR ART FIG. 2
Figure 3:
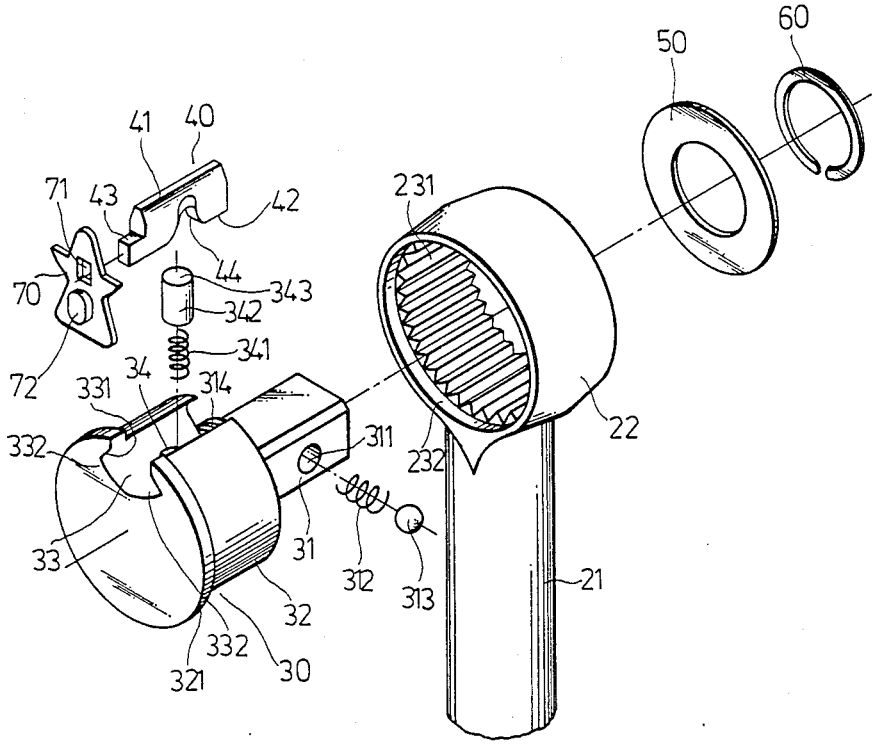
FIG. 3 is an exploded view of a preferred embodiment of a ratchet wrench according to the invention.
Figure 4:
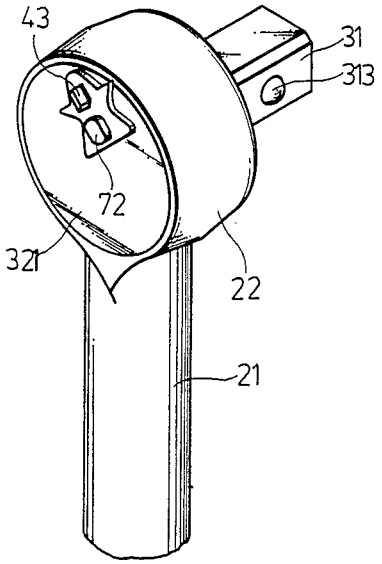
FIG. 4 is a perspective view of the ratchet wrench of the same embodiment as FIG. 3.
Figure 5:
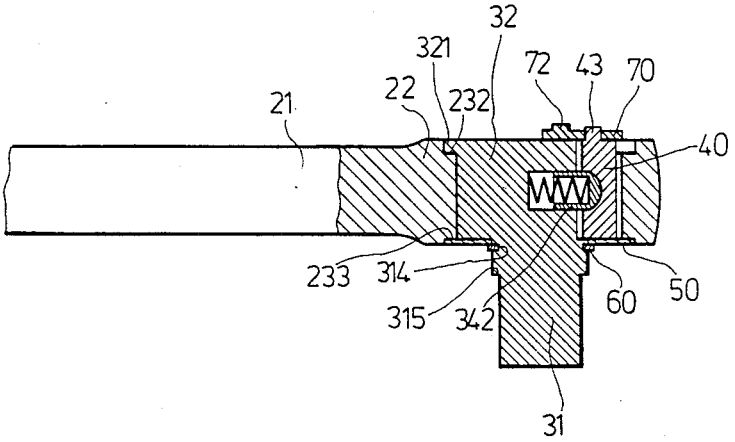
FIG. 5 is a sectional view of the ratchet wrench of the same embodiment as FIG. 3.

Referring to FIGS. 3, 4 and 5, there is shown a ratchet wrench which includes a cylindrical housing 22 which is in a one piece construction with a handle 21. On the inner side of the wall of the housing 22 are formed a plurality of inwardly extending wedge-shaped teeth 231, each tooth 231 having two converging inclined faces, and and at the ends of the housing 22 are formed annular recesses 232 and 233.

In the housing 22 is provided a torque transmitting member 30 which includes a cylindrical body 32 received in the housing 22. The cylindrical body 32 has a flanged end portion 321 received in the annular recess 232 of the housing 22 and a shaft 31 of rectangular cross-section which is one piece with the cylindrical body 32 and protrudes out of the housing 22 to be coupled with a wrench socket. At the throat section between the body 32 and the shaft 31 are provided an annular groove 314 and an annular flange 315. An annular plate 50 is sleeved on the shaft 31 and is received in annular recess 233 of the housing 22. A lock ring 60 is sleeved on the shaft 31 and is received in annular groove 314, thereby clamping the plate 50 against the body 32 and securing the body 32 in the housing 22. In recess 311 of the shaft 31 is disposed a spring 312 and a ball 313 through which a wrench socket can be attached to the shaft 31.

In the cylindrical body 32 is provided an axial groove 33 which opens at the peripheral surface thereof and a bore 34 which extends radially outward to communicate with the groove 33. A protrusion means, which includes a hollow cylindrical pin body 342 received in bore 34 and a round closed end 343, projects outwardly. A spring 341 is provided in bore 34, biassing the body 342 radially. The groove 33 is confined by two diverging surfaces 332 which are symmetrical with respect to the axis of bore 34, two converging surfaces 331 extending from the diverging surfaces 332 respectively and being symmetrical with the axis of bore 34, and two edges 333 each of which interconnects said converging surface 331 and the peripheral surface of the body 32. Each converging surface 331 is made parallel with one of the converging inclined faces of one tooth 231 and is at right angles to the adjacent diverging surface 332, forming a right angled corner 334.

Figure 6:
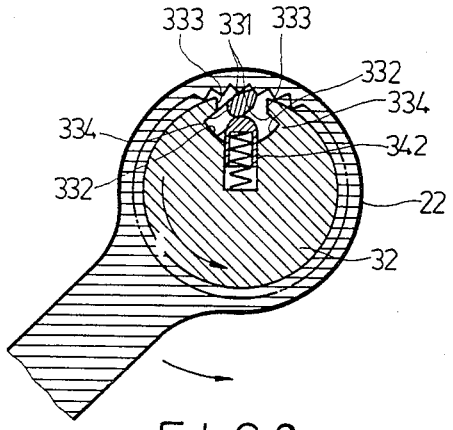
FIGS. 6 and 7 illustrate different positions of the pawl in relation to the ratchet teeth when the handle is operated.

There is further provided a pawl means which has a pawl body 40 disposed axially in groove 33 and having an oblong cross-section in the plate perpendicular to the axis of the cylindrical body 32. The pawl body 40 has a first longitudinal end portion 41 to engage with teeth 231, and a second longitudinal end portion 42, which is opposite first longitudinal end portion 41 and is provided with a recess 44 which receives the protrusion means 342, the indented surface 45 which partly confines the recess 44 being slightly curved. The second longitudinal end portion 42 includes two adjacent longitudinal right angled corners to engage with corners 334 of the groove 33. The first longitudinal end portion 41 is tapered and and has two endmost corners of obtuse angle. A portion 43 of the pawl body 40, which has a rectangular cross-section, extends out of the housing 22 from the flanged end 321 of the cylindrical body 32. To the portion 43 of the pawl body 40 is fitted fixedly a guide plate 70 which is substantially of a star shape and covers the groove 33. The guide plate 70 has a rectangular opening 71 sleeved on the portion 43 fixedly and a knob 72 projecting therefrom to be manipulated by the user's hand. The second longitudinal end portion 42 of the pawl body 40 can be moved, by operating the knob 72, between two corners 334, passing through the protrusion means 342 to change first longitudinal end portion 41 from a first position, in which first longitudinal end portion 41 engages with teeth 231 so as to move cylindrical body 32 anticlockwise together with the housing 22 as shown in FIG. 6, to a second position, in which first longitudinal end portion 41 engages with teeth 231 to move cylindrical body 32 clockwise together with the housing 22 as shown in FIG. 8. The protrusion means 342 thrusts the indented surface 45 of the pawl body 40, which partly confines recess 44, so as to engage first and second end portions 41 and 42 with teeth 231 and either of the corners 334 respectively.

In operation, the shaft 31 of the cylindrical body 32, which will transmit the torque applied through the handle 21 and the housing 22, is fitted to a wrench socket which in turn will be attached to a fastener. When the pawl means 40 is placed in a position in which the first longitudinal end portion 41 engages with teeth 231 and second longitudinal end portion 42 engages with left corner 334 by the action of the protrusion means 40 as shown in FIG. 6, the cylindrical body 32 moves anticlockwise as the handle 21 moves anticlockwise. When the housing 22 is moved clockwise, teeth 231 of the housing 22 will depress pawl means 40 against the biassing action of protrusion means 342 and pass thereover so that the cylindrical body 32 does not move simultaneously with the movement of the housing 22.

Figure 7:
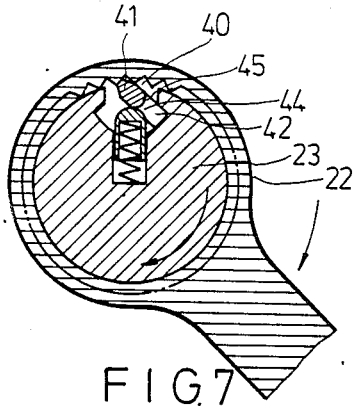

If it is desired to change the position of pawl means 40 to that shown in FIG. 7, second longitudinal end portion 42 of pawl means 40 is moved to right corner 334 of groove 33 passing through protrusion means 342 by turning knob 72 of guide plate 70. The slightly curved and indented surface 45 slides over the round end 343 of the protrusion means 342 when pawl means 40 is moved. In this position, the cylindrical body 32 can move clockwise with the clockwise movement of the housing 22, but does not move anticlockwise in spite of anticlockwise movement of the housing 22.

It can be appreciated that the construction of the pawl according to the invention is simpler than that of the conventional pawl. Since the pawl is not pivoted, breakage due to the stress concentration at the pivoted portion will not occur. The torque wrench according to the invention can bear a torque of above 60 kg fm and therefore is stronger in construction than the aforementioned conventional wrench which can bear a torque of about 40 kg fm.

With the invention thus explained, it is apparent that various modifications and variations can be made without departing from the scope of the invention. It is therefore intended that the invention be limmited as indicated in the appended claims.

What I claim is:

1. A ratchet wrench comprising:

a cylindrical housing having a plurality of teeth each of which has two converging faces and projects inwardly from the inner side of the wall thereof;

a handle with its one end connected to the periphery of said housing;

a torque transmitting member which has a cylindrical body mounted in said housing and has a shaft extending from one end of said body out of said housing, said body having an axial groove opening at the peripheral surface of said body, a bore extending radially outward to communicate with said groove, and a protrusion means received in said bore and biassed radially, said groove being confined by two diverging surfaces which are symmetrical with the axis of said bore, two converging surfaces extending from said diverging surfaces respectively and being symmetrical with the axis of said bore, and two edges each of which interconnects said converging surface and the peripheral surface of said body;

a pawl means having a pawl body axially disposed in said groove and having an oblong cross-section in the plane perpendicular to the axis of said cylindrical body, said pawl body having a first longitudinal end portion to engage with said teeth, and a second longitudinal end portion which is opposite said first longitudinal end portion and is provided with a recess which receives said protrusion means, said second longitudinal end portion being movable between two corners formed by adjacent said diverging and converging surfaces by passing through said protrusion means to change said first longitudinal end portion from a first position, in which said first longitudinal end portion engages with said teeth to cause said cylindrical body to move anticlockwise together with said housing, to a second position, in which said first longitudinal end portion engages with said teeth to cause said cylindrical body to move clockwise together with said housing, said protrusion means thrusting said pawl body to cause said first and second end portions to engage said teeth and said corners respectively.

2. A torque wrench as claimed in claim 1, wherein said protrusion means includes a hollow cylindrical body received in said bore and having a round closed end projecting outward, and a helical spring received in said bore and biassing said hollow cylindrical body.

3. A torque wrench as claimed in claim 2, wherein said pawl means further includes a portion of rectangular cross-section projecting out of said housing, and a guide plate which is fixed to said projecting portion and is provided with a knob thereon for operating said pawl means.

4. A torque wrench as claimed in claim 3, in which said diverging surface and said converging surface form a right angled corner.

5. A torque wrench as claimed in claim 4, wherein said first longitudinal end portion of said pawl means is tapered and has two endmost adjacent corners of obtuse angle, and said second longitudinal end portion includes two adjacent right angled corners.

* * * * *